US012332032B2

(12) United States Patent
Tal et al.

(10) Patent No.: US 12,332,032 B2
(45) Date of Patent: Jun. 17, 2025

(54) BARRIER-BREACHING MUNITION

(71) Applicant: RAFAEL ADVANCED DEFENSE SYSTEMS LTD., Haifa (IL)

(72) Inventors: Nadav Tal, Haifa (IL); Yoel Drive, Haifa (IL); Eyal Cohen, Haifa (IL); Lusia Oposhnian, Haifa (IL)

(73) Assignee: RAFAEL ADVANCED DEFENSE SYSTEMS LTD., Haifa (IL)

( * ) Notice: Subject to any disclaimer, the term of this patent is extended or adjusted under 35 U.S.C. 154(b) by 0 days.

(21) Appl. No.: 18/292,322

(22) PCT Filed: Jul. 24, 2022

(86) PCT No.: PCT/IL2022/050795
§ 371 (c)(1),
(2) Date: Jan. 25, 2024

(87) PCT Pub. No.: WO2023/007483
PCT Pub. Date: Feb. 2, 2023

(65) Prior Publication Data

US 2025/0093137 A1 Mar. 20, 2025

(30) Foreign Application Priority Data

Jul. 27, 2021 (IL) ..... 285253

(51) Int. Cl.
*F42B 12/20* (2006.01)

(52) U.S. Cl.
CPC ..... *F42B 12/207* (2013.01); *F42B 12/204* (2013.01)

(58) Field of Classification Search
CPC ..... F42B 12/207; F42B 12/204
USPC ..... 102/374–381, 473
See application file for complete search history.

(56) References Cited

U.S. PATENT DOCUMENTS 2,470,489 A * 5/1949 Hopkins ..... F42B 15/00 102/379
3,026,772 A * 3/1962 Moreland ..... F02K 9/20 89/1.51
4,364,530 A * 12/1982 Ripley-Lotee ..... F42B 10/665 102/378
5,853,143 A * 12/1998 Bradley ..... F42B 15/00 102/374

(Continued)

FOREIGN PATENT DOCUMENTS

FR 2702556 A1 9/1994
WO WO-2013130518 A1 * 9/2013 ..... F41G 7/00

(Continued)

*Primary Examiner* — Samir Abdosh
(74) *Attorney, Agent, or Firm* — FULLER IP LAW LLC; Rodney J. Fuller

(57) ABSTRACT

Flown munition that is rocket-propelled for hitting a target behind a barrier, and which comprises a rocket motor; and a successive payload that is mounted behind the rocket motor in a tandem configuration and is towed by it; and wherein the rocket motor is used for accelerating the munition towards the barrier and also serves as a sort of kinetic penetrator to clear a passage through the barrier for the successive pay load, which is connected to it and towed by it, and the successive payload (e.g.—a high-explosive charge) is adapted for delayed detonation following and just after said rocket motor hits the barrier.

12 Claims, 6 Drawing Sheets

(56) References Cited

U.S. PATENT DOCUMENTS

| | | | | | |
|---|---|---|---|---|---|
| 6,021,716 | A * | 2/2000 | Taylor | F42B 12/625 | 244/3.28 |
| 6,276,277 | B1 * | 8/2001 | Schmacker | F42B 12/20 | 102/374 |
| 6,494,140 | B1 * | 12/2002 | Webster | F42B 15/00 | 102/374 |
| 6,494,935 | B2 | 12/2002 | Cho | | |
| 6,568,330 | B1 * | 5/2003 | Kaiserman | F42B 5/38 | 89/1.816 |
| 6,601,517 | B1 * | 8/2003 | Guirguis | F42B 12/08 | 102/478 |
| 6,640,720 | B1 * | 11/2003 | Biserød | F42B 15/36 | 102/377 |
| 6,928,931 | B1 * | 8/2005 | Biserød | F42B 15/00 | 102/253 |
| 9,018,572 | B2 * | 4/2015 | Facciano | F42B 10/663 | 102/374 |
| 10,718,750 | B1 * | 7/2020 | McDaniel | C12Q 1/6888 | |
| 2012/0145028 | A1 * | 6/2012 | Travis | F42B 10/66 | 102/377 |
| 2015/0204640 | A1 * | 7/2015 | Ames | F42B 12/10 | 102/476 |

FOREIGN PATENT DOCUMENTS

| | | | | |
|---|---|---|---|---|
| WO | 2019090399 | A1 | 5/2019 | |
| WO | WO-2023007483 | A1 * | 2/2023 | F42B 12/08 |

* cited by examiner

BARRIER-BREACHING MUNITION

CROSS-REFERENCE TO RELATED APPLICATIONS

This application is the U.S. National Stage of International Patent Application No. PCT/IL2022/050795, filed on Jul. 24, 2022, which claims the benefit of and priority to Israeli Patent Application No. 285253, filed on Jul. 27, 2021, the contents of each of which are hereby incorporated by reference in their entireties.

FIELD

The various embodiments described herein generally relate to rocket-propelled flown munition, which is launched for attacking a target behind a barrier (e.g. wall, window, door, fence, side of a vehicle).

BACKGROUND OF THE INVENTION

An urban battlefield poses a challenge for infantry combatants of hitting an enemy target behind a barrier, e.g., hitting an enemy combatant situated in the space of a room and sheltered by the wall of the room (other examples are behind a door, window, fence or inside a vehicle). The relatively lightweight and compact munition carried by infantry combatants may comprise grenade or rocket launchers, which when used against an enemy combatant(s) situated behind a barrier, may prove ineffective, as the explosive charge of the munition, which is naturally relatively compact, will be detonated immediately upon hitting the outside of the barrier, without impacting the enemy behind it.

In response to the challenge, LASM (Light Anti Structure Munition) or wall-breaching munition were developed, which comprise a Break-in-Charge (BIC) aimed at opening a passage in the barrier and a Follow Through Bomb (FTB) for delayed detonation after passing through the passage.

In referring to FIG. 1. FIG. 1 is a schematic view of an example of munition 10 of this type. This is a rocket-propelled flown munition, which is launched for hitting a target behind a barrier (e.g., behind a wall, window, door, fence, vehicle wall), according to the illustrated example, munition 10 is suitable to be launched from an RPG type of launcher.

Munition 10 comprises fuse 15, which is mounted on its nose, in the front of the munition (relative to the direction of flight), aerodynamic canopy 20, conical or hemispheric shaped explosive charge 25, successive high-explosive charge 30, which is mounted in tandem behind the shaped explosive charge, rocket motor 35, folded fins (wings) 40, and low-explosive charge 45.

Detonating low-explosive charge 45 propels munition 10 out of the launcher (not illustrated), so that rocket motor 35 is ignited away from the launcher (thereby reducing the risk to the shooter). The operation of rocket motor 35, while deploying fins 40, accelerates the munition in the intended course towards the barrier behind which the enemy is situated. Once the munition hits the barrier, fuse 15 is activated, which detonates shaped explosive charge 25, while ensuring a stand-off from the barrier (using aerodynamic canopy 20), in a way that any skilled person understands will create the Munroe effect for clearing a passage through the barrier for successive high-explosive charge 30 (shaped explosive charge 25 is in fact used as a precursor warhead to successive high-explosive charge 30). Successive high-explosive charge 30 is adapted for a slight delayed detonation, just following and immediately after the detonation of shaped explosive charge 25, and at the stage where rocket motor 35 and fins 40 are connected to it from behind as a redundant weight that does not take part in the attack.

The prior art configuration to which we pointed out above, in referring to FIG. 1, increases the dimensions and weight of the munition that is heavy and bulky for the combatants to carry, reduces the amount of munitions of this type they can carry, reduces and changes the aerodynamic performance of the munition and thus effect its accuracy (reduces range and changes course if the same rocket motor, fins and low-explosive charge is used as is usual when using regular munition of the type without a successive explosive charge, e.g. anti-tank munition).

Moreover, due to the bulky dimensions of the prior art munition (adding the successive explosive charge), the prior art configuration is not suitable for implementation in munition that is adapted for launching from grenade launchers (such as M320 Grenade Launcher Module (GLM)), which are limited by the dimensions and weight of the munition that can be loaded and launched from them.

Furthermore, implementing the prior art munition in an urban, short range and civilian crowded type of battlefield, might cause severe collateral damage due to the explosion of the Break-in-Charge (BIC) on the outer side of the barrier.

At the same time, there are known weapon systems that implement a rocket motor that once launched, tows a chain of explosives behind it for various purposes other than attacking a target behind a barrier (the purpose that we are dealing with), but rather, for example, for the deployment of a chain of explosives on a minefield and detonating them remotely to clear a safe passage through it. An example of such a system is the M58 Mine Clearing Line Charge (MICLIC) and a towing rocket motor for such systems is described, for example, in U.S. Pat. No. 6,494,935.

Therefore, prior to the Patent Application, there was a need to address the challenge of hitting an enemy behind a barrier by using munition that will be relatively lightweight and compact, thereby making it possible for infantry combatants to carry such munition in a considerable quantity and launching it safely by using grenade launchers (such as M320 Grenade Launcher Module (GLM)), which as stated pose severe limits as to the size of the munition that can be loaded and launched from them.

SUMMARY OF THE INVENTION

Aspects and embodiments are directed to rocket-propelled flown munition, which is launched to hit a target behind a barrier (e.g. behind a wall, window, door, fence, side of a vehicle), and is characterized by the rocket motor that is mounted in the front part of the munition (relative to the direction of flight); and the munition comprises a successive payload (e.g., high-explosive charge) that is mounted behind the rocket motor in a tandem configuration and is towed by it, in such a way that the rocket motor is used not only to accelerate the munition toward the barrier, but in addition, the rocket motor is also used as a sort of kinetic penetrator to clear a passage through the barrier for said successive payload that is connected to it and towed by it, and said successive payload is adapted for a slight delayed activation (e.g. detonation) following and just after said rocket motor hits the barrier.

According to one aspect the invention is embodied in a flown munition that is rocket-propelled for hitting a target behind a barrier. Wherein the munition comprises a rocket motor and a successive high-explosive charge that is mounted behind said rocket motor in a tandem configuration and towed by it, and wherein the rocket motor is used to accelerate the flight of the munition towards the barrier and also serves as a sort of kinetic penetrator for clearing a passage through the barrier for the successive high-explosive charge that is connected to it and towed by it, and the successive high-explosive charge is adapted for a slight delayed detonation, following and just after the rocket motor hits the barrier.

According to another aspect the munition according to the invention is adapted for launching from a grenade launcher towards a target behind a barrier such as a wall, window, door, fence, or side of a vehicle; and the munition additionally comprises a low-explosive charge that is mounted behind the successive payload and is connected to it for blasting the munition and ejecting it from the launcher barrel, and an array of fins that is mounted around the low-explosive charge, behind the successive payload wherein it is connected to it, and the fins can be deployed once the munition is ejected from the launcher and cleared from the barrel.

The mode of operation of munition according to the invention is also embodied by a general method for hitting a target situated behind a barrier, which comprises the steps of accelerating the munition towards the barrier by means of the rocket motor, slamming the rocket motor to hit the barrier as a sort of kinetic penetrator for clearing a passage through the barrier for the successive payload (e.g. high-explosive charge) that is connected to the rocket motor and towed by it, and the detonation of the successive payload following and just after the rocket motor hits the barrier.

Still other aspects, embodiments, and advantages of these exemplary aspects and embodiment are discussed in detail below. Embodiments disclosed herein may be combined with other embodiments in any manner consistent with at least one of the principles disclosed herein, and references to "an embodiment," "some embodiments," "an alternate embodiment," "various embodiments," "one embodiment" or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. In the figures, each identical or nearly identical component that is illustrated in various figures is represented by a like numeral. For purposes of clarity, not every component may be labeled in every figure. In the figures.

DETAILED DESCRIPTION

Figure 1:
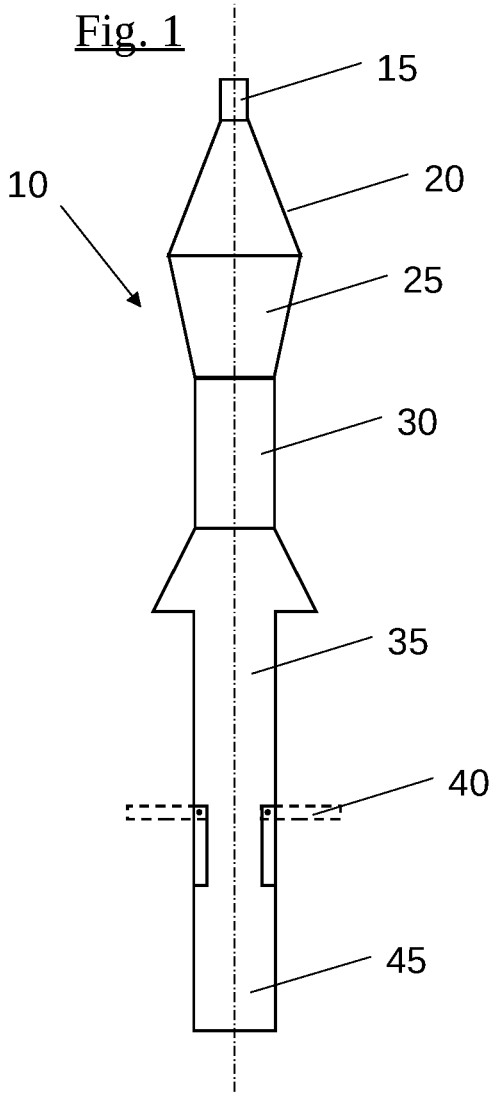
FIG. 1 is a schematic view of an example of a prior art munition that is used for hitting a target situated behind a barrier (e.g. a wall, window, door, fence, side of a vehicle).
Figure 2:
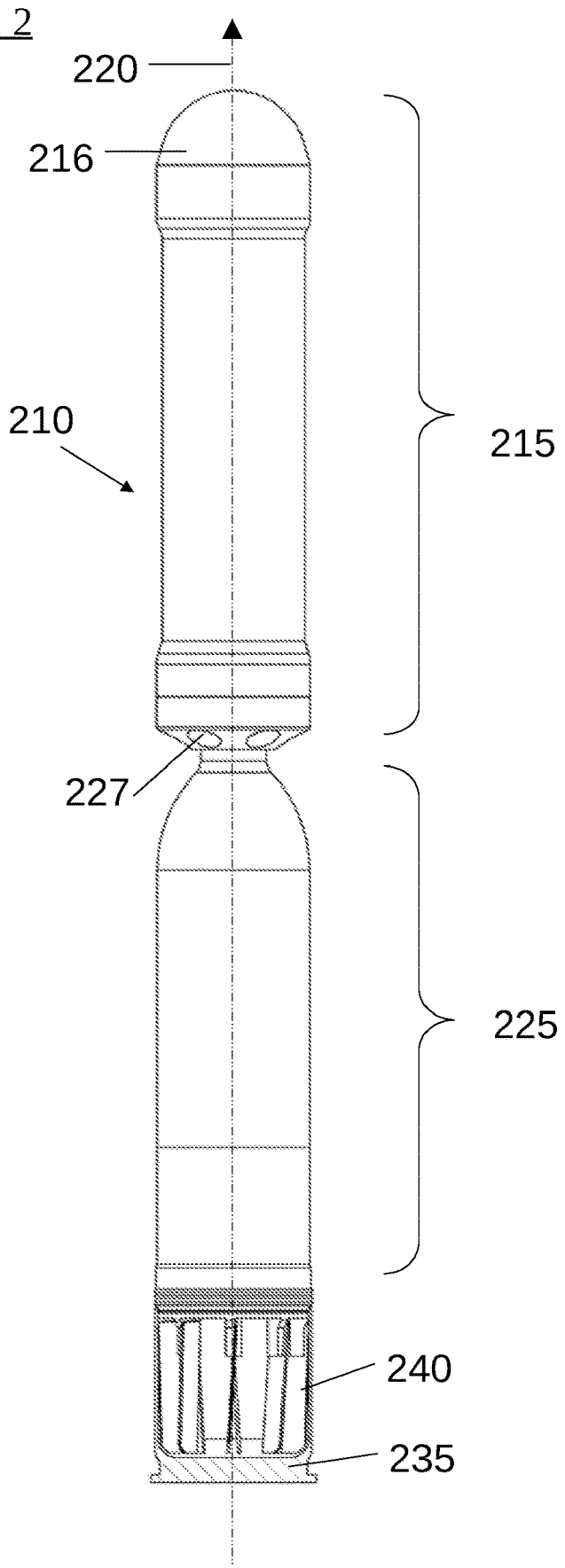
FIG. 2 is a is a schematic view of an example of the munition according to the invention that is designed for hitting a target situated behind a barrier (e.g. a wall, window, door, fence, side of a vehicle).

Aspects and embodiments are directed to rocket-propelled flown munition, which is launched to hit a target behind a barrier (e.g. behind a wall, window, door, fence, side of a vehicle), and is characterized by the rocket motor that is mounted in the front part of the munition (relative to the direction of flight); and the munition comprises a successive payload (e.g. high-explosive charge) that is mounted behind the rocket motor in a tandem configuration and is towed by it, in such a way that the rocket motor is used not only to accelerate the munition, but in addition, the rocket motor is also used as a sort of kinetic penetrator to clear a passage through the barrier for said successive payload that is connected to it and towed by it, and said successive payload is adapted for slightly delayed detonation following and just after the said rocket motor hits the barrier.

In particular, aspects and embodiment provide said munition, which is adapted for launch from a grenade launcher to hit a target behind a barrier, such as a wall, window, door, fence or the side of a vehicle, i.e. munition that is relatively lightweight and compact, thereby making it possible for infantry combatants to carry such munition in a considerable quantity and launching it safely by using grenade launchers (such as M320 Grenade Launcher Module (GLM)), which as stated pose severe limits as to the size of the munition that can be loaded and launched from them, towards a target situated behind a barrier that is relatively non-rigid.

It is to be appreciated that embodiment of the munition and method discussed herein are not limited in application to the details of construction and the arrangement of components set forth in the following description or illustrated in the accompanying figures. The munition and method are capable of implementation in other embodiments and of being practiced or of being carried out in various ways. Examples of specific implementation is provided herein for illustrative purposes only and are not intended to be limiting.

A skilled person will understand that the invention is not limited, as aforesaid, to the configuration described in referring to the accompanying figures, and is also applicable to various other rocket-propelled flown munition for hitting targets situated behind a barrier. For example—for air-ground munition that is designed for targeting infrastructure beneath an airport runway (the barrier) or for targeting infrastructure under a road (the barrier), or for artillery munition for breaching protective roofs (the barrier) and hitting occupants beneath them.

A skilled person will also understand that the invention is not limited to a successive payload containing high-explosive charge, but rather the successive payload may be, for example, a tear gas charge or smoke charge or other means for impacting target behind a barrier, to be pyrotechnically exploded and deployed. In addition, wherein the successive payload is indeed a high-explosive charge, a shard (shrapnel) creating features can be implemented in its structure.

In other words—while using the term successive payload and successive high-explosive charge interchangeably in the following description and claim chapters, one cannot preclude that it means either one of the abovementioned payloads.

In addition, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

Referring to FIGS. 2-5, which depict (respectively) a schematic view of an example of munition 210 according to the invention for hitting a target behind a barrier (e.g. a wall, window, door, fence, side of a vehicle), (not illustrated), a schematic view that exemplifies munition 210 while mounted in launcher 310, a schematic view exemplifying munition 210 just after actuation of low-explosive charge 235, and a schematic view of munition 210 once flown towards the barrier (not illustrated).

Munition 210 is rocket-propelled by means of rocket motor 215, mounted at the front part of the munition in reference to the direction of the flight (see arrow 220). Successive high-explosive charge 225 is mounted behind rocket motor 215 in a tandem configuration and towed by it.

According to the illustrated example, rocket motor 215 comprises a circumferential array of exhaust nozzles 227 in its rear section (in the illustrated example—an array of six nozzles), which face backward in an angular direction relative to the longitudinal axis of munition 210 (e.g.—at an angle of 15°-45°.

A skilled person will understand that the successive high-explosive charge may also be towed by a rocket motor with a circumferential array of such exhaust nozzles to be formed in its front part (as appears, for example, in RPG munitions). A skilled person will also understand that the direction of the array of exhaust nozzles may be used to stabilize the flight of the munition (e.g. by spinning the munition during flight along its longitudinal axis, which result in balanced and equal impact of the nozzles on the rocket flight).

According to the illustrated example, successive high-explosive charge 225 has a conical configuration in its front section, which is designed to reduce the disturbance to the rocket motor's emission gases and hardens the structure of the high-explosive charge, as necessary to facilitate its expected highly erosible passage through the barrier. The successive high-explosive charge may be mounted at the rear of the rocket motor using a mechanical connector, such as by threaded connector.

Therefore, according to the invention, rocket motor 215 serves for accelerating munition 210 towards the barrier (not illustrated), and once it slams into the barrier (when the munition strikes the barrier), rocket motor 215 additionally serves as a sort of kinetic penetrator for clearing a passage through the barrier for successive high-explosive charge 225, which is connected to it and towed by it.

According to the illustrated example, the nose section of rocket motor 215 is formed with a dome-like configuration 216, so that besides aerodynamic considerations, it also hardens the motor as required for slamming into the barrier (hitting the barrier) and its use from that time as a sort of kinetic penetrator for clearing a passage through the barrier for successive high-explosive charge 225, which is connected to it and towed by it. For example, the nose section of the rocket motor may be made from stainless steel PH H1025, Maraging 250 and the like, and may be formed either as a separate element to me mounted to the rocket motor or as an integral part thereof.

A skilled person will understand that the rocket motor structure may be designed in a different and in another fashion. For example, the nose section may be designed having a pointed configuration or by designing the rocket motor casing in a collapsible manner once it hits the barrier (e.g. by means of forming weakening grooves along its length), so that the nose section will breach the barrier and open a passage for the successive high-explosive charge, whereas the motor casing will collapse in a rose-like configuration to enable the successive high-explosive charge to pass through it.

Successive high-explosive charge 225 is adapted for a slight delayed detonation, following and just after rocket motor 215 hits the barrier. A skilled person will understand that a slight delayed detonation of successive high-explosive charge 225 may be implemented by mounting a fuse with an accelerometer or piezoelectric component providing the necessary signal upon hitting the target and triggering timing mechanism such as pyrotechnic, electric or mechanical mechanism (as is standard for detonating a successive high-explosive charge in prior art munition (see above in the Background of the Invention chapter)).

Figure 3:
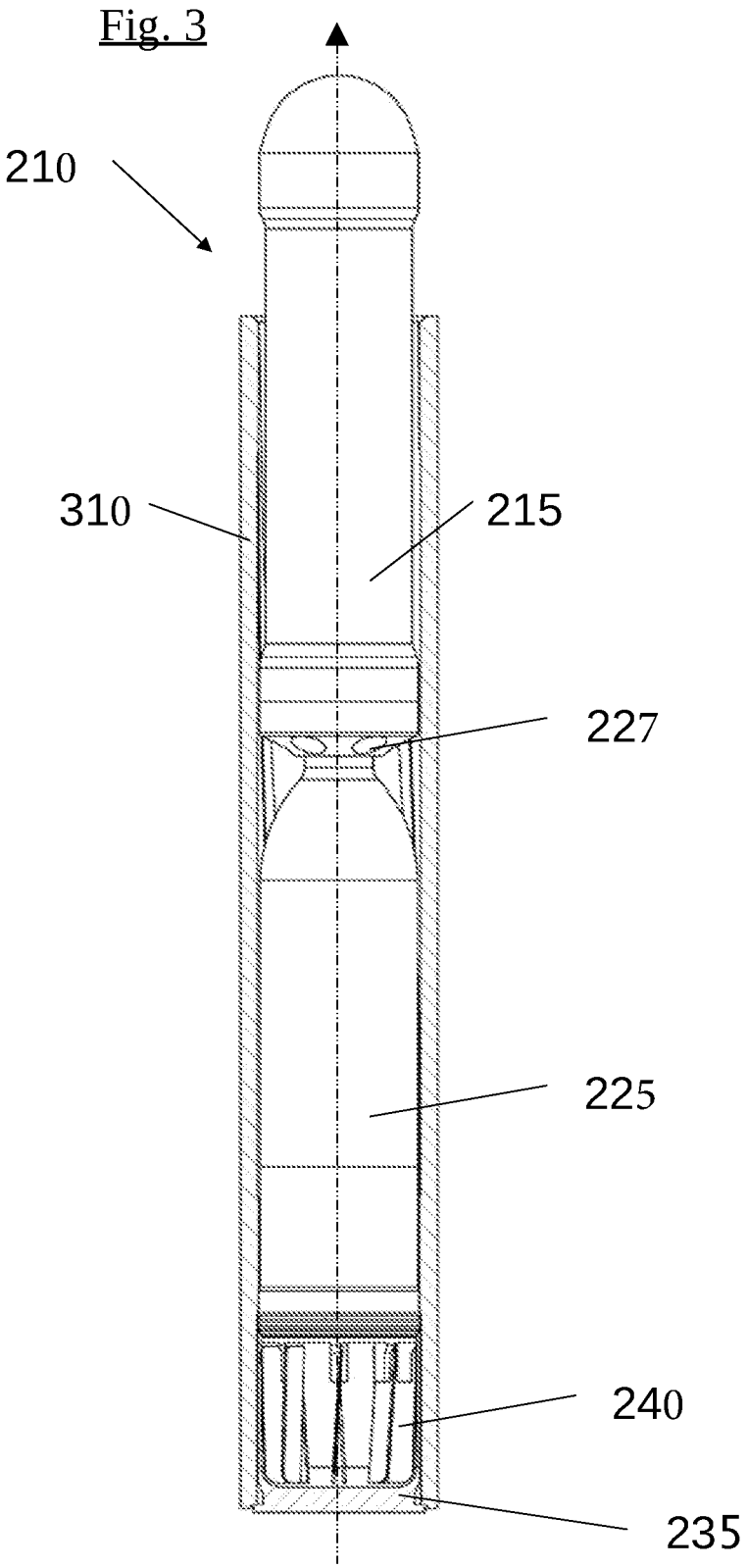
FIG. 3 is a is a schematic view of an example of the munition according to the invention, as illustrated in FIG. 2, and mounted to a launcher.
Figure 4:
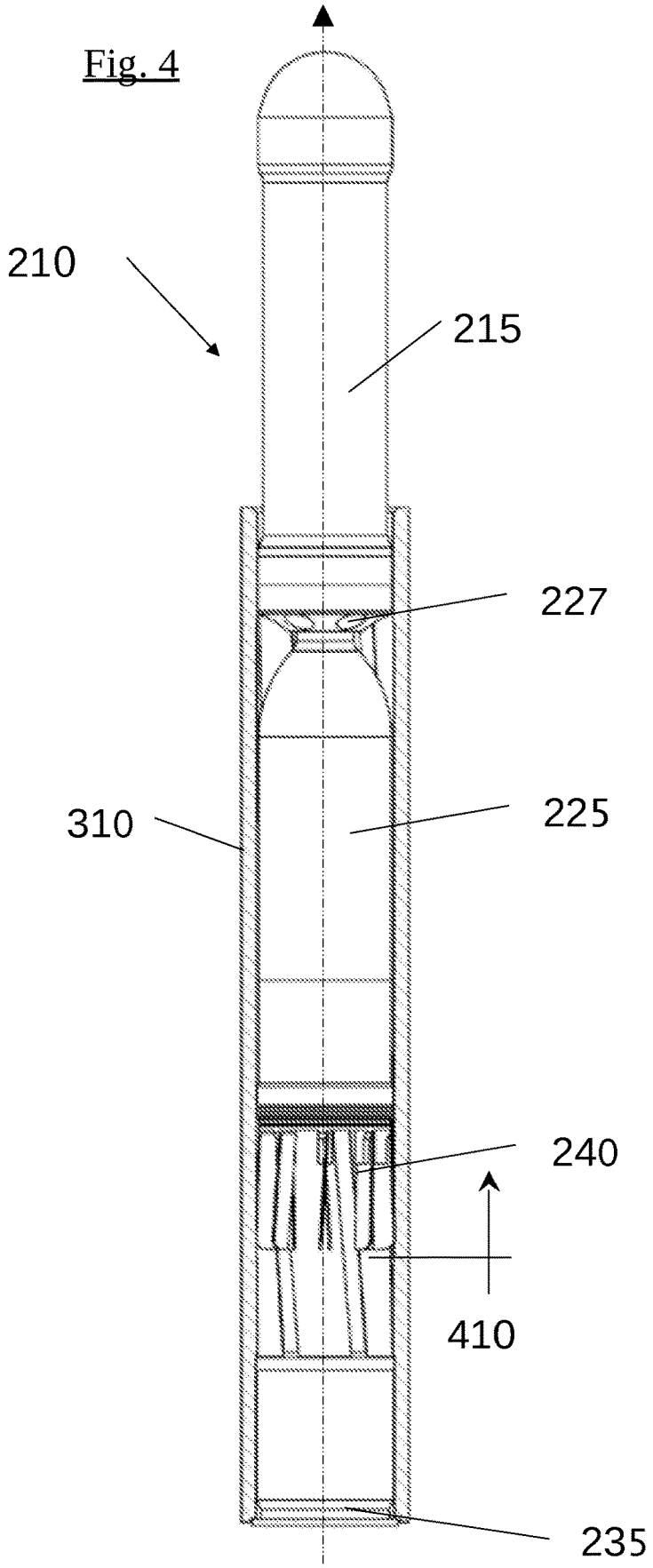
FIG. 4 is a is a schematic view of an example of the munition according to the invention, as illustrated in FIG. 2, following the detonation of the low-explosive charge.
Figure 5:
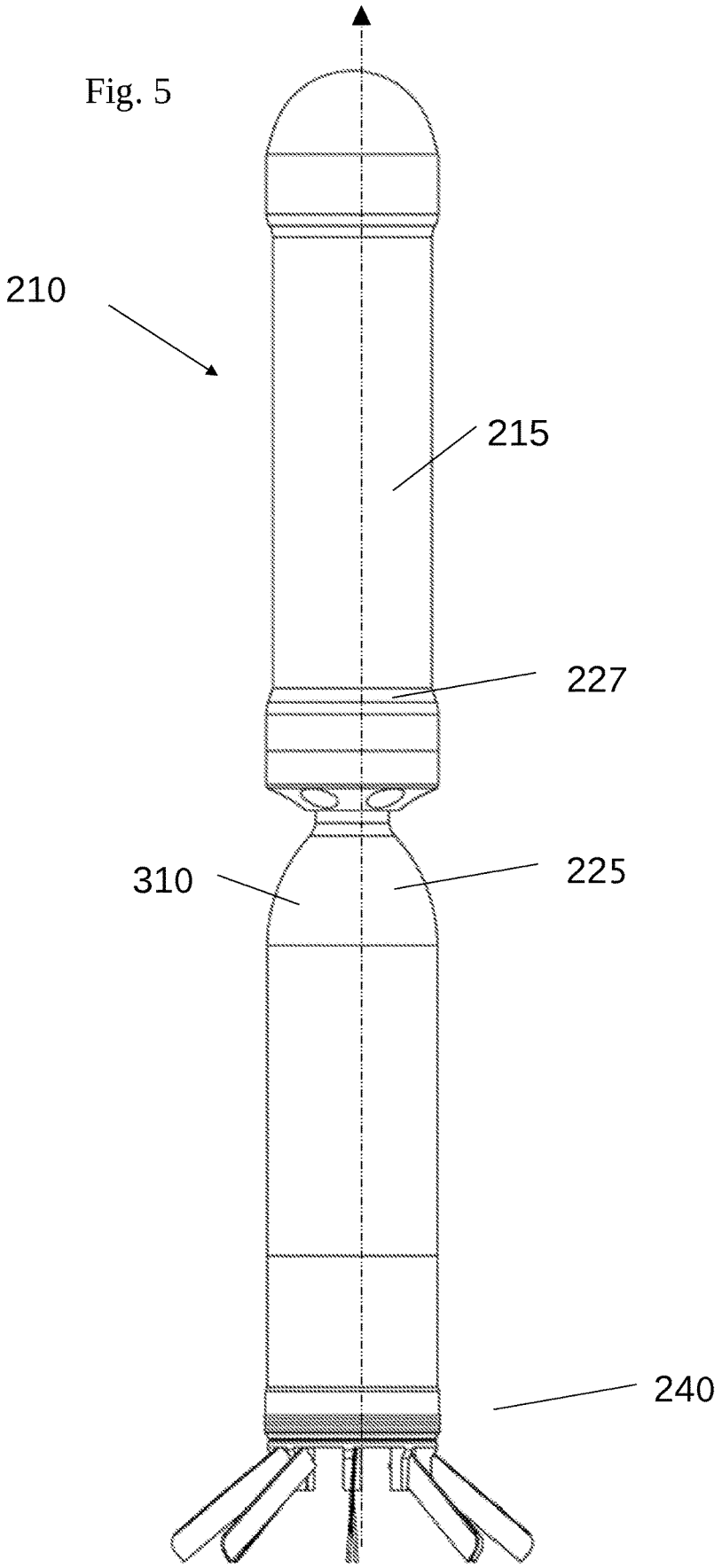
FIG. 5 is a is a schematic view of an example of the munition according to the invention, as illustrated in FIG. 2, once launched towards the barrier.

As stated, munition 210 is adapted, according to the invention, to be launched from a grenade launcher, which only a section of its barrel 310 is illustrated in FIGS. 3 and 4. Therefore, munition 210 additionally comprises low-explosive charge 235, which is mounted behind successive high-explosive charge 225, connected to it, and serves for blasting the munition and ejecting it from the launcher (see FIG. 4 in the direction of arrow 410).

A low-explosive charge, such as low-explosive charge 235, is usually used in munition launched from grenade launchers and contains a low-explosive, such as gunpowder. The low-explosive charge is a disposable cartridge that forms an integral part of the munition and is loaded in conjunction with it (see FIGS. 2 and 3—the low-explosive cartridge is an integral part of the loaded munition). The low-explosive charge is the first low-power motor that ejects the munition from the barrel and away from the shooter, thereby meeting the requirements of U.S. Army TOP 3-2-504. Immediately after activation (e.g. by a striking pin), the residues of the low-explosive charge remaining inside the launcher (see FIG. 4—the base of the low-explosive charge cartridge), are ejected once the launcher is opened for reloading.

A skilled person will understand that detonating low-explosive charge 235 in munition 210 may also be used for a slight delayed ignition of the propellant of rocket motor 210 (e.g. by means of a nozzle that will be formed along the munition and will transmit a flash created by the activation of the low-explosive charge to the rocket motor propellant, as is required for igniting it, or by means of wiring an immediate fuse wire that will be detonated once the low-explosive charge is activated and will transmit the flash, as is required, as stated, for igniting the rocket motor).

Also, according to the illustrated example, munition 210 comprises circumferential array of fins 240, which is mounted around low-explosive charge 235 behind successive high-explosive charge 225 wherein it is connected to it. Fins 240 are deployed once the munition is ejected from the launcher (see FIG. 5), and the illustrated example depict a circumferential array of eight fins.

Fins 240 are used as stabilizing fins during the flight of munition 210. The fins are usually incorporated inside the low-explosive cartridge, and a skilled person will understand that their deployment is facilitated in a free aerodynamic manner (due to the operation of centrifugal forces) or by means of springs or by means of electromechanical actuators.

According to the illustrated example, munition 210 is provided with a rotational stabilizing motion around its longitudinal axis already in launcher barrel 310 (by means of grooves that are formed from the start in the launcher barrel). However, a person skilled in the art will appreciate that this stabilizing spin of the munition is also produced either by an inclined formation of the rocket motor's array of exhaust nozzles or by means of forming the array of fins with an angular tilt of their angle of attack relative to the longitudinal axis of the munition (the flight direction).

Figure 6A:
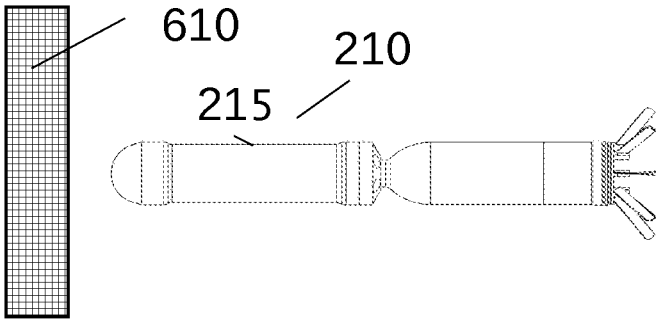
FIGS. 6*a*-6*c* are a schematic sequence of schematic views illustrating the mode of operation of the munition according to the invention for striking barrier and the target behind it, as illustrated in FIG. 2.
Figure 6B:
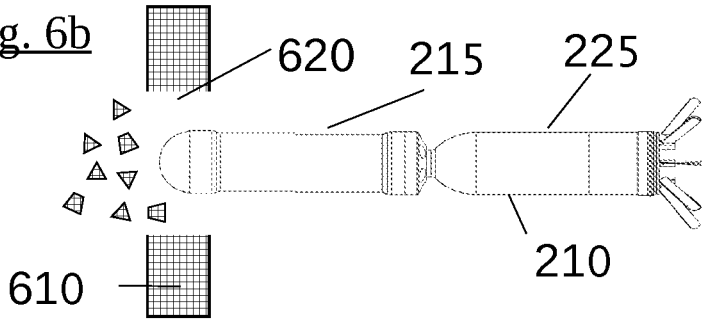
Figure 6C:
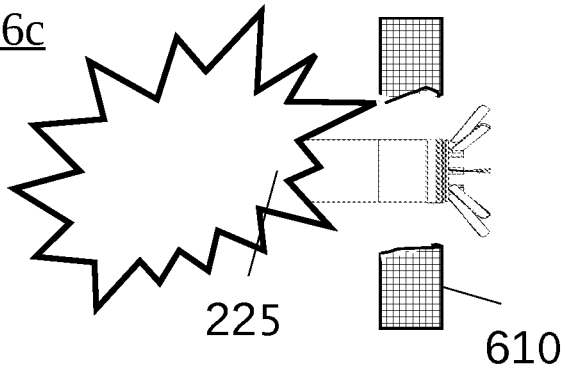

Reference is made to FIGS. 6*a*-6*c*. FIGS. 6*a*-6*c* depict a schematic sequence of views illustrating the mode of operation exemplifying munition 210 on barrier 610 (for example—a wall, window, door, fence, or side of a vehicle behind which the enemy is situated).

In the first stage and as illustrated in FIG. 6*a*, after the ejection of munition 210 from the launcher by means of a low-explosive cartridge 235, munition 210 is flown towards barrier 610 by means of rocket motor 215, and once it approaches the barrier, the operation of the rocket motor may already be completed (the rocket motor propellant is already exhausted).

In the second stage and as illustrated in FIG. 6*b*, munition 210 is hurled at barrier 610. Rocket motor 215, whose nose first hits the barrier and is therefore used as a sort of kinetic penetrator for clearing passage 620 through the barrier for successive high-explosive charge 225, which is connected to rocket motor 215 and is towed by it.

In the third stage and as illustrated in FIG. 6*c*, successive high-explosive charge 225 is detonated for delayed explosion only after it passes through barrier 610 (or at least, inside barrier 610), in a manner that maximizes the ability to hit the target behind it.

In light of the description given above, in referring to the accompanying figures, a skilled person will appreciate the fact that the mode of operation of the munition according to the invention also embodies a general method for hitting a target behind a barrier. A method which comprises the step of accelerating munition (210) towards barrier (610) by means of rocket motor (215), a step of hurling rocket motor (215) to hit barrier (610) as a sort of kinetic penetrator for clearing a passage through barrier (610) for successive payload (225), which is connected to rocket motor (215) and towed by it, and a step of detonating the successive payload (225) following and just after rocket motor (215) hits barrier (610).

Therefore, without detracting from the possibilities of implementing the invention that is the subject of the Patent Application in other and different munitions (as indicated at the beginning of the chapter), the subject invention, in its preferred configuration as described above, in referring to the accompanying figures, responds to the challenge of striking at an enemy situated behind a barrier using munition that is relatively lightweight and compact, thereby making it possible for infantry combatants to carry such munition in a considerable quantity and launching it safely by using grenade launchers (such as M320 Grenade Launcher Module (GLM)), which, as stated, pose severe limits as to the size of the munition that can be loaded and launched from them.

It was found that the design of the munition according to the invention, may allow for munition weighing 0.8-1.2 kg, 300-500 mm in length and 30-50 mm diameter. Munition according to the preferred configuration of the invention, as described above in referring to the accompanying figures, may allow for munition weighing 1 kg, 400 mm in length, and 40 mm in diameter.

Finally, the breaching of the barrier by utilizing the rocket motor as a sort of kinetic penetrator (at a stage wherein the rocket motor propellant may already exhausted), as defined by the invention, while therefore, avoiding explosion of a Break-in-Charge (BIC) for this purpose on the outer side of the barrier (as described hereinabove in the background of the invention chapter), will be appreciated also in the aspect of minimizing unnecessary collateral damage (a sensitive issue in urban, short range and civilian crowded type of battlefield).

Having described above several aspects of at least one embodiment, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

The invention claimed is:

1. A flown munition that is rocket-propelled for hitting a target behind a barrier, and which comprises:

a rocket motor; and a successive payload that is mounted behind said rocket motor in a tandem configuration and is towed by the rocket motor; and wherein said rocket motor is used for accelerating the munition towards the barrier and also serves as a sort of kinetic penetrator to clear a passage through the barrier for said successive payload, which is connected to and towed by the rocket motor, and said successive payload is adapted for delayed detonation following and just after said rocket motor hits the barrier.

2. The munition according to claim 1, wherein the successive payload is a high-explosive charge.

3. The munition according to claim 1, wherein the munition is adapted for launching from a grenade launcher towards a target behind a barrier as a wall, window, door, fence, or side of a vehicle; and the munition additionally comprises:

a low-explosive charge that is mounted behind said successive payload and is connected to said successive payload for ejecting the munition from the launcher; and an array of fins that is mounted behind said successive payload wherein the array of fins is connected to the successive payload, and the fins are deployable once the munition is ejected from the launcher.

4. The munition according to claim 1, wherein the munition is further comprising a nose element formed in a dome-like configuration, to harden said rocket motor impact upon hitting said barrier.

5. The munition according to claim 1, wherein said rocket motor is formed with a circumferential array of exhaust nozzles positioned at the rear section of said motor, and in angular direction relative to the longitudinal axis of the munition.

6. The munition according to claim 3 wherein the munition weight is 0.8-1.2 kg, it's 300-500 mm in length and 30-50 mm in diameter.

7. A method for hitting a target behind a barrier by means of a munition according to claim 1, which comprises the steps of:

accelerating the munition towards the barrier by means of said rocket motor; and hurling the rocket motor to hit the barrier as a sort of kinetic penetrator for clearing a passage through the barrier for said successive payload that is connected to the rocket motor and towed by the rocket motor ; and detonation of said payload following and just after the rocket motor hits the barrier.

8. The method for hitting a target behind a barrier by means of a munition according to claim 7, wherein the successive payload is a high-explosive charge.

9. The method for hitting a target behind a barrier by means of a munition according to claim 7, wherein the munition is adapted for launching from a grenade launcher towards a target behind a barrier as a wall, window, door, fence, or side of a vehicle; and the munition additionally comprises:

a low-explosive charge that is mounted behind said successive payload and is connected to said successive payload for ejecting the munition from the launcher; and an array of fins that is mounted behind said successive payload wherein the array of fins is connected to the successive payload, and the fins are deployable once the munition is ejected from the launcher.

10. The method for hitting a target behind a barrier by means of a munition according to claim 7, wherein the munition is further comprising a nose element formed in a dome-like configuration, to harden said rocket motor impact upon hitting said barrier.

11. The method for hitting a target behind a barrier by means of a munition according to claim 7, wherein said rocket motor is formed with a circumferential array of exhaust nozzles positioned at the rear section of said motor, and in angular direction relative to the longitudinal axis of the munition.

12. The method for hitting a target behind a barrier by means of a munition according to claim 7, wherein the munition weight is 0.8-1.2 kg, it's 300-500 mm in length and 30-50 mm in diameter.

* * * * *